US010839751B2

(12) United States Patent
Wu et al.

(10) Patent No.: US 10,839,751 B2
(45) Date of Patent: Nov. 17, 2020

(54) SCAN DRIVING CIRCUIT, SCAN DRIVER AND DISPLAY DEVICE

(71) Applicant: KunShan Go-Visionox Opto-Electronics Co., Ltd, Kunshan (CN)

(72) Inventors: Jianlong Wu, Kunshan (CN); Siming Hu, Kunshan (CN); Hui Zhu, Kunshan (CN)

(73) Assignee: KunShan Go-Visionox Opto-Electronics Co., Ltd., Kunshan (CN)

( * ) Notice: Subject to any disclaimer, the term of this patent is extended or adjusted under 35 U.S.C. 154(b) by 97 days.

(21) Appl. No.: 16/265,717

(22) Filed: Feb. 1, 2019

(65) Prior Publication Data

US 2019/0164499 A1 May 30, 2019

Related U.S. Application Data

(63) Continuation of application No. PCT/CN2018/106932, filed on Sep. 21, 2018.

(30) Foreign Application Priority Data

Jan. 19, 2018 (CN) ..... 2018 1 0055643

(51) Int. Cl.
*G09G 3/3266* (2016.01)

(52) U.S. Cl.
CPC ... *G09G 3/3266* (2013.01); *G09G 2310/0286* (2013.01); *G09G 2310/06* (2013.01); *G09G 2310/08* (2013.01)

(58) Field of Classification Search
CPC ..... G09G 2310/0286; G09G 2310/06; G09G 2310/08
See application file for complete search history.

(56) References Cited

U.S. PATENT DOCUMENTS 8,248,348 B2 * 8/2012 Murakami ..... G09G 3/3611 326/62
10,516,384 B2 * 12/2019 Shin ..... H03K 17/687
(Continued)

FOREIGN PATENT DOCUMENTS

CN 102831860 A 12/2012
CN 202736453 U 2/2013
(Continued)

OTHER PUBLICATIONS

European Search Report in European Application No. 18900697.6 dated Jun. 4, 2020.
(Continued)

*Primary Examiner* — Dinh T Le

(57) ABSTRACT

Embodiments of the present application provide a scan driving circuit, a scan driver and a display device. The scan driving circuit includes a first control module, a second control module and an output module. The output module includes a first switching unit, a second switching unit and a scan driving signal output end. The first switching unit and the second switching unit are connected in parallel and are connected with the scan driving signal output end. A port of the first switching unit is away from the scan driving signal output end to receive a second clock signal. A port of the second switching unit is away from the scan driving signal output end to receive a first reference signal. A function of outputting the scan driving signal by using fewer components is realized with the scan driving circuit according to the embodiments of the present application.

17 Claims, 5 Drawing Sheets

(56) References Cited

U.S. PATENT DOCUMENTS

| | | | | |
|---|---|---|---|---|
| 2005/0030276 | A1* | 2/2005 | Murakami | G11C 19/28 345/102 |
| 2010/0301818 | A1* | 12/2010 | Kim | H03K 3/35613 323/282 |
| 2011/0222645 | A1 | 9/2011 | Tobita | |
| 2014/0111490 | A1 | 4/2014 | Lee et al. | |
| 2014/0266386 | A1* | 9/2014 | Huang | H03K 3/012 327/333 |

FOREIGN PATENT DOCUMENTS

| | | | |
|---|---|---|---|
| CN | 103489423 | A | 1/2014 |
| CN | 103680397 | A | 3/2014 |
| CN | 104183219 | A | 12/2014 |
| CN | 104200769 | A | 12/2014 |
| CN | 104299652 | A | 1/2015 |
| CN | 105096823 | A | 11/2015 |
| CN | 105139801 | A | 12/2015 |
| CN | 105632561 | A | 6/2016 |
| CN | 105788644 | A | 7/2016 |
| CN | 105976749 | A | 9/2016 |
| CN | 106297630 | A | 1/2017 |
| CN | 106297670 | A | 1/2017 |
| CN | 106910453 | A | 6/2017 |
| CN | 106920498 | A | 7/2017 |
| CN | 108447448 | A | 8/2018 |
| TW | 201501102 | A | 1/2015 |
| TW | I591609 | B | 7/2017 |

OTHER PUBLICATIONS

Chinese First Office Action dated Jun. 27, 2019 in CN Application No. 201810055643.4, includes English Translation. 22 pages.

Taiwan First Office Action for Application No. 107135522 dated Jun. 17, 2019.

* cited by examiner

SCAN DRIVING CIRCUIT, SCAN DRIVER AND DISPLAY DEVICE

CROSS-REFERENCE TO RELATED APPLICATIONS

This application is a continuation of International Application No. PCT/CN2018/106932 filed on Sep. 21, 2018, which claims priority to Chinese patent application No. 201810055643.4 filed on Jan. 19, 2018. Both applications are incorporated herein in their entireties by reference.

TECHNICAL FIELD

The present application generally relates to the field of display technologies, particularly to a scan driving circuit, a scan driver and a display device.

BACKGROUND

In recent years, various types of display devices have been developed in the world, such as liquid crystal display devices, plasma display devices, electrowetting display devices, electrophoretic display devices, organic light emitting display devices and so on. With composite of electronic and cavities in specific materials, lights of specific wavelengths may be emitted from the organic light emitting display devices to display images. The organic light emitting display devices have advantages of fast response, low power consumption, being light and thin, wide color gamut and so on.

An organic light emitting display device in prior art includes a scan driver and a pixel unit. The scan driver is used to supply a scan signal to a scan line in sequence, and apply the scan signal to the pixel unit in sequence by means of the scan line. However, a scan driving circuit in the scan driver is complicated and takes up a large space.

SUMMARY

In view of this, the embodiments of the present application provide a scan driving circuit, a scan driver and a display device. The scan driving circuit is simplified by reducing the number of switching components, and then the space occupied by the scan driving circuit is reduced, which facilitates a development trend of display devices having narrow frames.

According to a first aspect, a scan driving circuit according to an embodiment of the present application includes a first control module, a second control module and an output module. The output module includes a first switching unit, a second switching unit and a scan driving signal output end, the first switching unit and the second switching unit are connected in parallel and are jointly connected with the scan driving signal output end. A port of the first switching unit away from the scan driving signal output end is configured to receive a second clock signal, and a port of the second switching unit away from the scan driving signal output end is configured to receive a first reference signal. The first control module is configured to receive a first clock signal and a start signal, and an operating state of the first switching unit is controlled according to the first clock signal and the start signal. The second control module is configured to receive a second reference signal, and an operating state of the second switching unit is controlled according to the operating state of the first control module and the second reference signal.

Further, the first control module includes a first switching component, the first switching component includes a first control end, a first channel end and a second channel end. The first control end of the first switching component is configured to receive the first clock signal, and the second channel end of the first switching component is configured to receive the start signal. The second control module includes a second switching component and a third switching component. The second switching component includes a second control end, a third channel end and a fourth channel end. The second control end of the second switching component is configured to be connected with the first channel end of the first switching component. The fourth channel end of the second switching component is configured to receive the first clock signal. The third switching component includes a third control end, a fifth channel end and a sixth channel end. The third control end of the third switching component is configured to receive the first clock signal. The fifth channel end of the third switching component is configured to be connected with the third channel end of the second switching component. The sixth channel end of the third switching component is configured to receive the second reference signal. The first switching unit of the output module includes a fourth switching component, and the second switching unit of the output module includes a fifth switching component. The fourth switching component includes a fourth control end, a seventh channel end and an eighth channel end. The fourth control end of the fourth switching component is configured to be connected with the second control end of the second switching component. The eighth channel end of the fourth switching component is configured to receive the second clock signal. The fifth switching component includes a fifth control end, a ninth channel end and a tenth channel end. The fifth control end of the fifth switching component is configured to be connected with the fifth channel end of the third switching component. The ninth channel end of the fifth switching component is configured to receive the first reference signal, and the tenth channel end of the fifth switching component is configured to be connected with the seventh channel end of the fourth switching component.

Further, the first control module further includes a sixth switching component, and the sixth switching component includes a sixth control end, an eleventh channel end and a twelfth channel end. The sixth control end of the sixth switching component is configured to receive the second reference signal. The eleventh channel end of the sixth switching component is configured to be connected with the second control end of the second switching component. The twelfth channel end of the sixth switching component is configured to be connected with the fourth control end of the fourth switching component.

Further, the first reference signal is a reference high voltage signal, and the second reference signal is a reference low voltage signal.

Further, the output module further includes a first conduction enhancement component. The seventh channel end of the fourth switching component is configured to be connected with the fourth control end through the first conduction enhancement component. The first conduction enhancement component is configured to reduce the conduction difficulty of the fourth switching component.

Further, the first conduction enhancement component is a capacitive component.

Further, the output module further includes a second conduction enhancement component. The ninth channel end of the fifth switching component is configured to be connected with the fifth control end of the fifth switching component through the second conduction enhancement component. The second conduction enhancement component is configured to reduce the conduction difficulty of the fifth switching component.

Further, the second conduction enhancement component is a capacitive component.

Further, the second conduction enhancement component is a parasitic capacitance of the fifth switching component.

Further, the start signal is a scan driving signal outputted by the scan driving circuit different with a preset number of stages.

Further, the preset number of stages is one, a start signal of a nth stage is a scan driving signal of a (n−1)th stage, and n is an integer greater than zero.

Further, at least one of the first switching component to the fifth switching component is a PMOS transistor.

Further, the first switching component is a double-gate PMOS transistor.

Further, the first clock signal and the second clock signal have a same duty ratio and a same cycle, and low levels of the first clock signal and those of the second clock signal are configured to be interleaved with each other.

According to a second aspect, a scan driver according to an embodiment of the present application includes the scan driving circuit mentioned in any of the above embodiments.

According to a third aspect, a display device according to an embodiment of the present application includes the scan driver mentioned in the above embodiment.

Further, the display device further includes a data driver, an emission control driver and a pixel panel, and the pixel panel displays pixels of an image according to a scan driving signal of the scan driver, an emission control signal of the emission control driver, and a data signal of the data driver.

The embodiments of the present application provide a scan driving circuit, a scan driver and a display device. In the scan driving circuit, cooperative linkages among the first control module, the second control module and the output module are realized by means of the first reference signal, the second reference signal, the start signal, the first clock signal and the second clock signal. Therefore, a function of outputting the scan driving signal by using fewer components is realized with the scan driving circuit according to the embodiments of the present application. Then, the scan driving circuit is simplified, the space occupied by the scan driving circuit is reduced, and a favorable condition for the development of display devices having narrow frames is provided. In particular, in an embodiment of the present application, the function of outputting the scan driving signal is realized by means of the first switching component, the second switching component, the third switching component, the fourth switching component and the fifth switching component in the scan driving circuit.

DETAILED DESCRIPTION

In order to make objects, technical solutions and advantages of the present application clearer, the present application will be further described in detail below with reference to accompanying drawings and embodiments. It should be understood that described embodiments are only part of the embodiments of the present application, and not all of them. Based on the embodiments of the present application, all other embodiments obtained by those skilled in the art without creative efforts fall within the scope of the present application.

Although terms such as first, second and third, etc. are used to describe different components or signals or ports, etc., the components, signals and ports, etc. are not limited in the terms. The terms are only used to distinguish one component, signal, port from another component, signal, port. In the embodiments of the present application, one component or port is "linked together", "connected" with another component or port, which may be understood as a direct electrical connection, or as an indirect electrical connection with an intermediate component. Unless otherwise defined, all terms used in the embodiments of the present application (including technical and scientific terms) have meanings which are generally understood by those skilled in the art.

Figure 1:
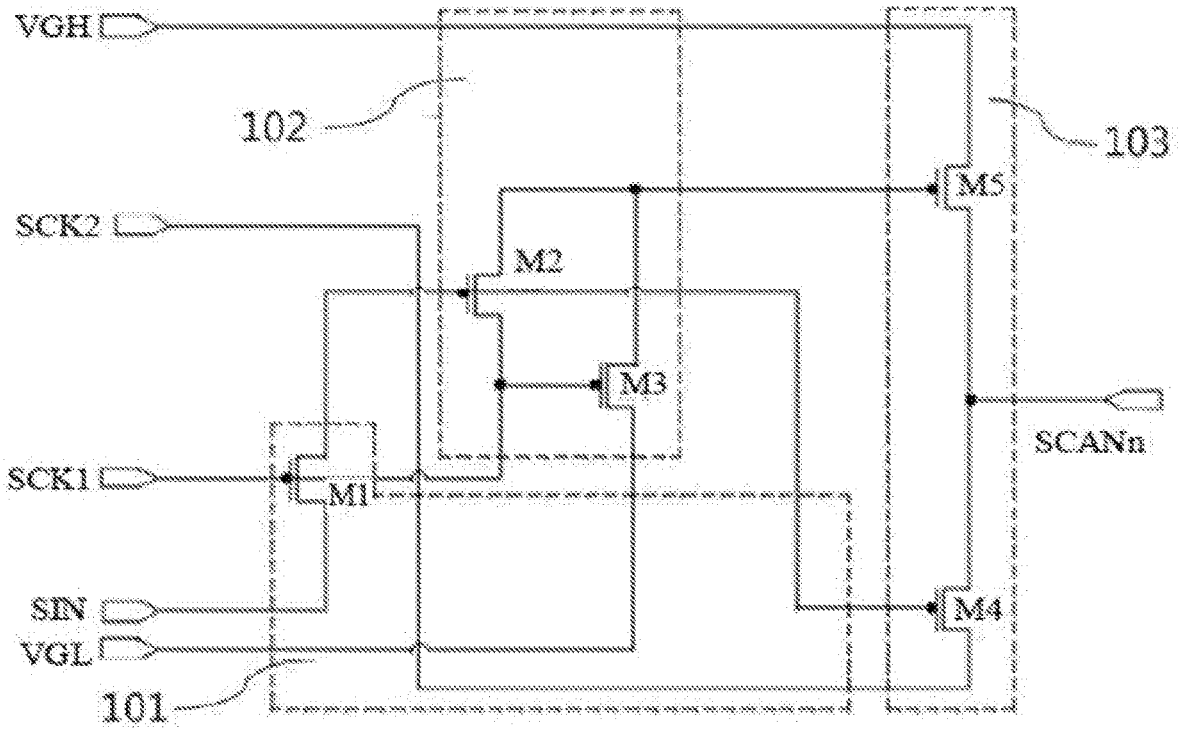
FIG. 1 is a circuit structural schematic diagram of a scan driving circuit according to a first embodiment of the present application.
Figure 2:
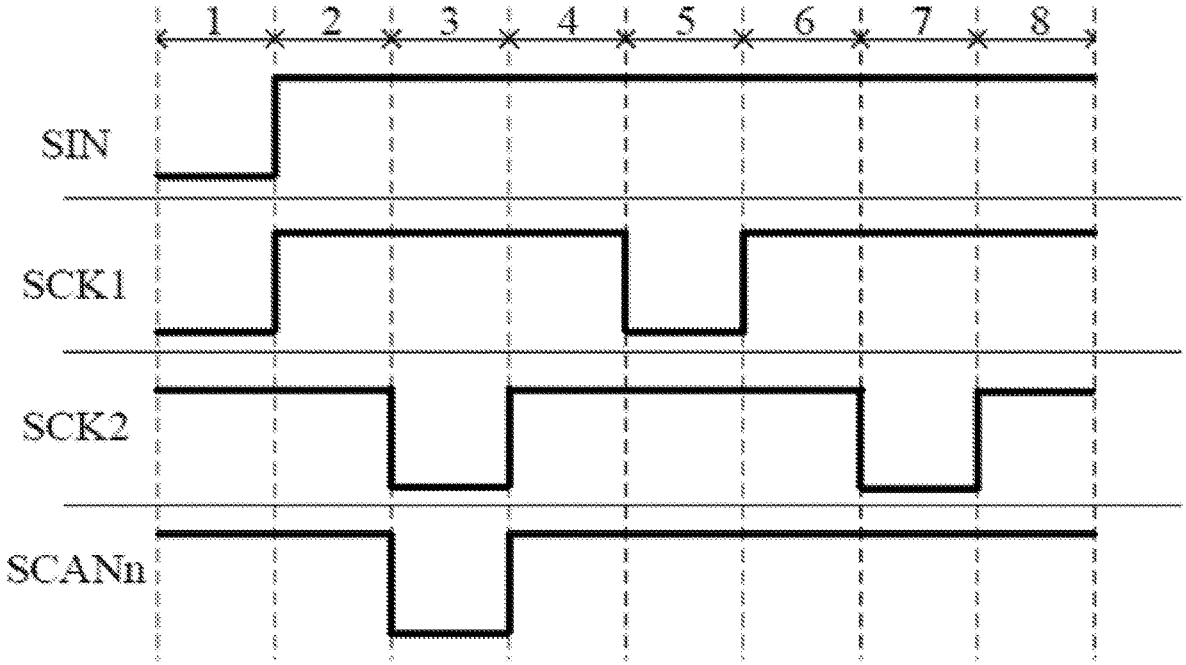
FIG. 2 is a waveform schematic diagram of a received signal and an output scan driving signal of the scan driving circuit according to the first embodiment of the present application.

FIG. 1 is a circuit structural schematic diagram of a scan driving circuit according to a first embodiment of the present application. FIG. 2 is a waveform schematic diagram of a received signal and an output scan driving signal of the scan driving circuit according to the first embodiment of the present application. In order to clearly describe the scan driving circuit according to the embodiment of the present application, please refer to FIGS. 1 and 2 at the same time.

Referring to FIG. 1, the scan driving circuit according to the first embodiment of the present application includes a first control module 101, a second control module 102 and an output module 103.

The first control module 101 includes a first switching component M1, and the first switching component M1 includes a first control end, a first channel end and a second channel end. The first control end of the first switching component M1 is configured to receive a first clock signal SCK1. The first channel end of the first switching component M1 is configured to be connected with a second control end of a second switching component M2. The second channel end of the first switching component M1 is configured to receive a start signal SIN.

In an embodiment of the present application, the first switching component M1 may be a double-gate transistor (in other embodiments of the present application, the transistor is a MOS transistor, which is also called as a metal-oxide-semiconductor field effect transistor), in order to reduce parasitic parameters and increase a cut-off frequency.

The second control module 102 includes a second switching component M2 and a third switching component M3. The second switching component M2 includes a second control end, a third channel end and a fourth channel end. The second control end of the second switching component M2 is configured to be connected with the first channel end of the first switching component M1. The third channel end of the second switching component M2 is configured to be connected with a fifth control end of a fifth switching component M5 of the output module 103. The fourth channel end of the second switching component M2 is configured to receive the first clock signal SCK1. The third switching component M3 includes a third control end, a fifth channel end and a sixth channel end. The third control end of the third switching component M3 is configured to receive the first clock signal SCK1. The fifth channel end of the third switching component M3 is configured to be connected with the third channel end of the second switching component M2. The sixth channel end of the third switching component M3 is configured to receive a reference low voltage signal VGL.

Referring to FIG. 1, the output module 103 includes a fourth switching component M4 and a fifth switching component M5, and the output module 103 is configured to output the scan driving signal SCANn.

The fourth switching component M4 includes a fourth control end, a seventh channel end and an eighth channel end. The fourth control end of the fourth switching component M4 is configured to be connected with the first channel end of the first switching component M1 of the first control module 101 (or the fourth control end is configured to be connected with the second control end of the second switching component M2). The seventh channel end of the fourth switching component M4 is configured to be connected with a tenth channel end of the fifth switching component M5. The eighth channel end of the fourth switching component M4 is configured to receive a second clock signal SCK2.

Referring to FIG. 1, the fourth control end of the fourth switching component M4 is configured to be connected with the first channel end of the first switching component M1 of the first control module 101. Therefore, the fourth switching component M4 is controlled to be turned on or off according to the first control module 101.

Referring to FIG. 1, the fifth switching component M5 includes a fifth control end, a ninth channel end and a tenth channel end. The fifth control end of the fifth switching component M5 is configured to be connected with the fifth channel end of the third switching component M3 (or the fifth control end is configured to be connected with the third channel end of the second switching component M2). The ninth channel end of the fifth switching component M5 is configured to receive a reference high voltage signal VGH. The tenth channel end of the fifth switching component M5 is configured to be connected with the seventh channel end of the fourth switching component M4 to output a nth stage scan driving signal SCANn, and the n is an integer greater than zero.

In an embodiment of the present application, when the n is greater than 1, the start signal SIN is a scan driving signal of a (n−1)th stage. That is to say, in addition to a scan driving circuit in a first stage, in a scan driving circuits in any other stage, the start signal SIN is a scan driving signal SCAN (n−1) of a previous stage outputted by a scan driving circuit in the previous stage (not shown in FIG. 1, please refer to FIG. 2). Besides, since the scan driving circuit in the first stage does not have the scan driving signal of the previous stage, the start signal SIN of the scan driving circuit in the first stage may be externally supplied.

Referring to FIG. 1, since the fifth control end of the fifth switching component M5 is configured to be connected with the fifth channel end of the third switching component M3 of the second control module 102, the fifth switching component M5 is controlled to be turned on or off according to the second control module 102.

In an embodiment of the present application, the first switching component M1, the second switching component M2, the third switching component M3, the fourth switching component M4 and the fifth switching component M5 of the scan driving circuit according to the embodiment of the present application are all P-type transistors (in the embodiment, the P-type transistors are P-type MOS transistors), and the P-type transistors are transistors which are turned on in a low level. In another embodiment of the present application, the first switching component M1 may be a double-gate P-type MOS transistor. A double-gate MOS transistor is a kind of structure that can increase the cut-off frequency by reducing the parasitic parameters. An effective electrostatic shielding effect between a first gate and a drain is obtained with a second gate is set to AC grounding, and then a feedback capacitance between the gate and the drain may be greatly reduced, and thereby the frequency may be increased.

FIG. 2 is a waveform schematic diagram of a received signal and an output scan driving signal of the scan driving circuit according to the first embodiment of the present application. As shown in FIG. 2, the first clock signal SCK1 and the second clock signal SCK2 have a same duty ratio and a same cycle, and low levels of the first clock signal SCK1 and those of the second clock signal SCK2 are configured to be interleaved with each other. A duty ratio is a proportion of a low level (or a high level) in a clock signal in one cycle (the duty ratio of the low levels in this embodiment is twenty-five percent, but it is not limited to this).

The low levels of the first clock signal SCK1 and those of the second clock signal SCK2 are configured to be interleaved with each other. That is to say, when one of the first clock signal SCK1 and the second clock signal SCK2 is in the low level, the other one may not be in the low level. And it may be understood that when one of the first clock signal SCK1 and the second clock signal SCK2 is in the high level, the other one may be simultaneously in the high level.

Referring to FIG. 2, the start signal SIN, the first clock signal SCK1, and the second clock signal SCK2 are divided into eight stages in a cycle. A conduction state of each switching component at each stage and a level state of a scan driving signal that is outputted according to the switching component are shown in Table 1.

TABLE 1

| | | M1 | M2 | M3 | M4 | M5 | SCAN |
|---|---|---|---|---|---|---|---|
| 1 | SIN↓, SCK1↓, SCK2↑ | ON | ON | ON | ON | ON | ↑ |
| 2 | SIN↑, SCK1↑, SCK2↑ | OFF | ON | OFF | ON | OFF | ↑ |
| 3 | SIN↑, SCK1↑, SCK2↓ | OFF | ON | OFF | ON | OFF | ↓ |
| 4 | SIN↑, SCK1↑, SCK2↑ | OFF | ON | OFF | ON | OFF | ↑ |
| 5 | SIN↑, SCK1↓, SCK2↑ | ON | OFF | ON | OFF | ON | ↑ |
| 6 | SIN↑, SCK1↑, SCK2↑ | OFF | OFF | OFF | OFF | ON | ↑ |
| 7 | SIN↑, SCK1↑, SCK2↓ | OFF | OFF | OFF | OFF | ON | ↑ |
| 8 | SIN↑, SCK1↑, SCK2↑ | OFF | OFF | OFF | OFF | ON | ↑ |

↑ indicates a high level,
↓ indicates a low level

In a first stage, the first clock signal SCK1 is in the low level. Since the first control end of the first switching component M1 is configured to receive the first clock signal SCK1 that is in the low level, the first switching component M1 and the third switching component M3 are turned on. Moreover, since the second channel end of the first switching component M1 is configured to receive the start signal SIN that is in the low level, the first channel end of the first switching component M1 is pulled low, so that the second switching component M2 is turned on. Since the fourth channel end of the second switching component M2 is configured to receive the first clock signal SCK1 that is in the low level, the sixth channel end of the third switching component M3 is configured to receive the reference low voltage signal VGL, so that the fifth control end of the fifth switching component M5 is pulled low according to the second switching component M2 that is turned on and the third switching component M3 that is turned on. Thereby, the fifth switching component M5 is turned on, and the tenth channel end of the fifth switching component M5 is maintained in the high level by the reference high voltage signal VGH through the fifth switching component M5 that is turned on, so that the nth stage scan driving signal SCANn outputted at this time is also in the high level. In addition, since the fourth control end of the fourth switching component M4 is configured to be connected with the first channel end of the first switching component M1, the fourth control end of the fourth switching component M4 is pulled low by the start signal SIN according to the first switching component M1 that is turned on. Thereby, the fourth switching component M4 is turned on, and since the second clock signal SCK2 is in the high level at this time, the nth stage scan driving signal SCANn outputted at this time is maintained in the high level by the second clock signal SCK2.

In a second stage, the first clock signal SCK1 is configured to be changed from the low level to the high level. Therefore, the first switching component M1 and the third switching component M3 are turned off, and the first channel end of the first switching component M1 is configured to be maintained in the low level of the first stage, so that the second switching component M2 is configured to continue being turned on. Since the third channel end of the second switching component M2 is pulled high by the first clock signal SCK1 through the second switching component M2 that is turned on, the fifth control end of the fifth switching component M5 is pulled high, and the fifth switching component M5 is turned off. In addition, since the first channel end of the first switching component M1 configured to be connected with the fourth control end of the fourth switching component M4 is in the low level, the fourth switching component M4 is turned on. Thereby, since the second clock signal SCK2 is in the high level at this time, the nth stage scan driving signal SCANn is maintained in the high level by the second clock signal SCK2 through the fourth switching component M4 that is turned on.

In a third stage, the first clock signal SCK1 and the start signal SIN are still in the high level shown in the second stage, but the second clock signal SCK2 is configured to be changed from the high level to the low level. Therefore, the first switching component M1 and the third switching component M3 are still turned off, the second switching component M2 is still turned on, the fourth switching component M4 is still turned on, and the fifth switching component M5 is turned off. Therefore, the nth stage scan driving signal SCANn is pulled low with the second clock signal SCK2 according to the fourth switching component M4 that is turned on.

In a fourth stage, since the first clock signal SCK1, the start signal SIN and the second clock signal SCK2 of the fourth stage are configured to be coincided with those of the second stage, the first switching component M1 is turned off, the second switching component M2 is turned on, the third switching component M3 is turned off, the fourth switching component M4 is turned on, the fifth switching component M5 is turned off at this time. Therefore, the nth stage scan driving signal SCANn outputted at this time is pulled high by the second clock signal SCK2 through the fourth switching component M4 that is turned on.

In a fifth stage, since the first clock signal SCK1 is configured to be changed from the high level to the low level, the first switching component M1 and the third switching component M3 are turned on. Since the start signal SIN and the second clock signal SCK2 are both in the high level, the second control end of the second switching component M2 and the fourth channel end of the fourth switching component M4 are both pulled high by the start signal SIN through the first switching component M1 that is turned on, and the second switching component M2 and the fourth switching component M4 are turned off. Since the third switching component M3 is turned on, and the fifth control end of the fifth switching component M5 is pulled low by the reference low voltage signal VGL through the third switching component M3 that is turned on, the fifth switching component M5 is turned on. Therefore, the nth stage scan driving signal SCANn is maintained in the high level by the reference high voltage signal VGL through the fifth switching component M5 that is turned on.

In a sixth stage, the first clock signal SCK1 is configured to be changed from the low level to the high level. Therefore, the first switching component M1 is turned off, and the first channel end of the first switching component M1 configured to be maintained in the high level of the fifth stage, so that the second switching component M2 and the fourth switching component M4 are configured to continue being turned off. However, since the first clock signal SCK1 is in the high level, the third switching component M3 is turned off, and the fifth channel end of the third switching component M3 is configured to be maintained in the low level of the fifth stage. Therefore, the fifth switching component M5 is configured to continue being turned on, and the nth stage scan driving signal SCANn is maintained in the high level.

The first clock signal SCK1 and the start signal SIN of a seventh stage and those of the sixth stage are the same, and only the second clock signal SCK2 of the seventh stage is different from the second clock signal SCK2 of the sixth stage. It may be seen from the sixth stage, since the fourth switching element M4 is turned off, a change of the second clock signal SCK2 has no influence on the nth stage scan driving signal SCANn outputted at this time. Therefore, the nth stage scan driving signal SCANn outputted at this time is still maintained in the high level.

The first clock signal SCK1 and the start signal SIN of an eighth stage and those of the sixth stage are the same, and the second clock signal SCK2 of the eighth stage and that of the sixth stage are also the same. Therefore, the eighth stage and the sixth stage are identical, so that the nth stage scan driving signal SCANn outputted at this time is still maintained in the high level.

In the scan driving circuit according to the embodiments of the present application, a normal scan driving signal may be outputted only according to the first switching component M1, the second switching component M2, the third switching component M3, the fourth switching component M4 and the fifth switching component M5 which are configured to be connected with each other. Therefore, the scan driving circuit is integrated with fewer components, a space occupied by the scan driving circuit is reduced, which is beneficial to a development trend of display devices having narrow frames.

Figure 3:
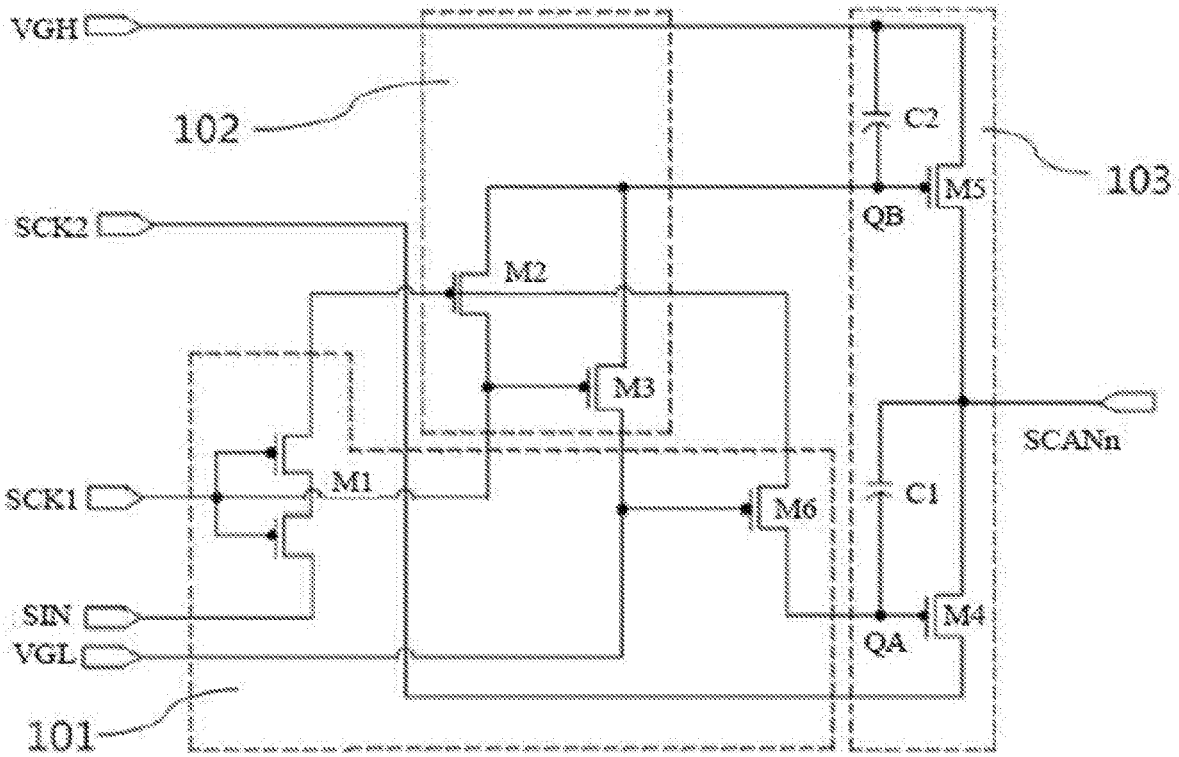
FIG. 3 is a circuit structural schematic diagram of a scan driving circuit according to a second embodiment of the present application.

FIG. 3 is a circuit structural schematic diagram of a scan driving circuit according to a second embodiment of the present application. In order to clearly describe the scan driving circuit according to the second embodiment of the present application, please refer to FIGS. 2 and 3 at the same time. The scan driving circuit of the embodiment is substantially the same as the scan driving circuit shown in FIG. 1, except that a first control module 101 further includes a sixth switching component M6, and an output module 103 further includes a first capacitor C1 and a second capacitor C2.

In an embodiment of the present application, specific embodiments and advantageous effects of the first switching component M1, the second switching component M2 and the third switching component M3 may refer to the first embodiment of the present application, and details are not described herein again.

Referring to FIG. 3, the sixth switching component M6 includes a sixth control end, an eleventh channel end and a twelfth channel end. The sixth control end of the sixth switching component M6 is configured to receive a reference low voltage signal VGL. The eleventh channel end of the sixth switching component is configured to be connected with a second control end of the second switching component M2. The twelfth channel end of the sixth switching component M6 is configured to be connected with a fourth control end of a fourth switching component M4.

Referring to FIG. 3, the fourth switching component M4 includes the fourth control end, a seventh channel end and an eighth channel end. The fourth control end of the fourth switching component M4 is configured to be connected with the twelfth channel end of the sixth switching component M6, and the seventh channel end of the fourth switching component M4 may be configured to be connected with the fourth control end of the fourth switching component M4 through the first capacitor C1. The eighth channel end of the fourth switching component M4 is configured to receive a second clock signal SCK2. Those skilled in the art may understand that the coupling effect of the first capacitor C1 is improved with a connection manner between the first capacitor C1 and the fourth switching component M4. Thereby, a voltage value of node QA is reduced, that is, a voltage value of the fourth control end of the fourth switching component M4 is reduced, so that a pull-low effect is achieved, and the fourth switching component M4 is more easily turned on.

That is to say, the first capacitor C1 is a first conduction enhancement component of the output module 103 to reduce the conduction difficulty of the fourth switching component M4. It may be understood that the first conduction enhancement component may also include other components, which is not uniformly defined in this embodiment of the present application.

Referring to FIG. 3, a fifth switching component M5 includes a fifth control end, a ninth channel end and a tenth channel end. The fifth control end of the fifth switching component M5 is configured to be connected with the fifth channel end of the third switching component M3. The ninth channel end of the fifth switching component M5 is configured to receive a reference high voltage signal VGH, and the ninth channel end of the fifth switching component M5 is further configured to be connected with the fifth control end of the fifth switching component M5 through the second capacitor C2. The tenth channel end of the fifth switching component M5 is configured to be connected with the seventh channel end of the fourth switching component M4 to output a nth stage scan driving signal, and the n is an integer greater than zero. When the n is greater than 1, the scan driving circuit according to the second embodiment of the present application has n stages, and a start signal SIN is a (n−1)th stage scan driving signal.

Those skilled in the art may understand that since the ninth channel end of the fifth switching component M5 is configured to receive the reference high voltage, and because the second switching component M2 and/or the third switching component M3 have a possibility of leakage, the charge loss of the fifth control end of the fifth switching component M5 may be caused, so that the quantity of electric charge of node QB is increased with a connection manner between the second capacitor C2 and the fifth switching component M5, and thereby a voltage value of the node QB is maintained. Therefore, a voltage value of the fifth control end of the fifth switching component M5 is made to be more stable, and the fifth switching component M5 is made to be more easily turned on.

That is to say, the second capacitor C2 is a second conduction enhancement component of the output module 103 to reduce the conduction difficulty of the fifth switching component M5. It may be understood that the second conduction enhancement component may also include other components, which is not uniformly defined in this embodiment of the present application.

In an embodiment of the preset application, the second capacitor C2 may be a parasitic capacitance of the fifth switching component M5.

Specifically, specific embodiments of the scan driving signal SCANn, the first clock signal SCK1 and the second clock signal SCK2 outputted with each stage of the multi-stage scan driving circuits are referred to the first embodiment, and details are not described herein again.

Also referring to FIG. 2, the start signal SIN, the first clock signal SCK1 and the second clock signal SCK2 are divided into eight stages in a cycle. A conduction state of each switching component at each stage and a level state of a scan driving signal that is outputted by the switching component are shown in Table 2.

TABLE 2

| | | M1 | M2 | M3 | M6 | M4 | M5 | SCAN |
|---|---|---|---|---|---|---|---|---|
| 1 | SIN↓, SCK1↓, SCK2↑ | ON | ON | ON | ON | ON | ON | ↑ |
| 2 | SIN↑, SCK1↑, SCK2↑ | OFF | ON | OFF | ON | ON | OFF | ↑ |
| 3 | SIN↑, SCK1↑, SCK2↓ | OFF | ON | OFF | OFF | ON | OFF | ↓ |
| 4 | SIN↑, SCK1↑, SCK2↑ | OFF | ON | OFF | ON | ON | OFF | ↑ |
| 5 | SIN↑, SCK1↓, SCK2↑ | ON | OFF | ON | ON | OFF | ON | ↑ |
| 6 | SIN↑, SCK1↑, SCK2↑ | OFF | OFF | OFF | ON | OFF | ON | ↑ |
| 7 | SIN↑, SCK1↑, SCK2↓ | OFF | OFF | OFF | ON | OFF | ON | ↑ |
| 8 | SIN↑, SCK1↑, SCK2↑ | OFF | OFF | OFF | ON | OFF | ON | ↑ |

↓ indicates a low level,
↑ indicates a high level

In a first stage, the first clock signal SCK1 is in the low level. Since the first control end of the first switching component M1 is configured to receive the first clock signal SCK1 that is in the low level, the first switching component M1 and the third switching component M3 are turned on. Moreover, since the second channel end of the first switching component M1 is configured to receive the start signal SIN that is in the low level at this time, the first channel end of the first switching component M1 is pulled low, so that the second switching component M2 is turned on. Since the fourth channel end of the second switching component M2 is configured to receive the first clock signal SCK1 that is in the low level, the sixth channel end of the third switching component M3 is configured to receive the reference low voltage signal VGL, so that the fifth control end of the fifth switching component M5 is pulled low through the second switching component M2 that is turned on and the third switching component M3 that is turned on. Thereby, the fifth switching component M5 is turned on, and the tenth channel end of the fifth switching component M5 is maintained in the high level by the reference high voltage signal VGH through the fifth switching component M5 that is turned on, so that the nth stage scan driving signal SCANn outputted at this time is also in the high level. In addition, the sixth control end of the sixth switching component M6 is configured to receive the reference low voltage signal VGL and then is pulled low, so that the sixth switching component M6 is turned on. Because the eleventh channel end of the sixth switching component M6 is configured to be connected with the first channel end of the first switching component M1, so the twelfth channel end of the sixth switching component M6 is pulled low, so that the fourth control end of the fourth switching component M4 configured to be connected with the twelfth channel end of the sixth switching component M6 is pulled low. In this way, the fourth switching component M4 is turned on, and since the second clock signal SCK2 is in the high level at this time, the nth stage scan driving signal SCANn outputted at this time is also maintained in the high level by the second clock signal SCK2.

Following analysis methods of the second to eighth stages may refer to the analysis methods of the first embodiment and the first stage of the present embodiment. The sixth switching component M6 is only turned off in the third stage, and is turned on in the second stage, in the fourth to eighth stages, Therefore, in any one of the second stage, the fourth to eighth stages, the analysis methods of the conduction state of each switching component and the level state of the scan driving signal that is outputted by the switching component may refer to those of the first embodiment and the first stage of the present embodiment, and details are not described herein again.

In the third stage, the first clock signal SCK1 and the start signal SIN are still the same as those of the second stage (in the high level), but the second clock signal SCK2 is configured to be changed from the high level to the low level. Therefore, the first switching component M1 and the third switching component M3 are turned off, and the first channel end of the first switching component M1 is maintained in the low level of the first stage, so that the second switching component M2 is configured to continue being turned on. The third channel end of the second switching component M2 is pulled high by the first clock signal SCK1 through the second switching component M2 that is turned on, so that the fifth control end of the fifth switching component M5 is pulled high, and the fifth switching component M5 is turned off. In addition, since the sixth control end of the sixth switching component M6 is configured to receive the reference low voltage signal VGL, the sixth switching component M6 is turned on. Since the eleventh channel end of the sixth switching component M6 is configured to be connected with the first channel end of the first switching component M1, the twelfth channel end of the sixth switching component M6 is pulled low, and thus the fourth control end of the fourth switching component M4 configured to be connected with the twelfth channel end of the sixth switching component M6 is also pulled low, so that the fourth switching component M4 is turned on. Since the second clock signal SCK2 is in the low level at this time, the nth stage scan driving signal SCANn outputted at this time is pulled low by the second clock signal SCK2, and at this time, since the seventh channel end of the fourth switching component M4 is configured to be connected with the fourth control end of the fourth switching component M4 through the first capacitor C1, the voltage of the node QA is reduced (i.e., a kickback effect is generated), so that the fourth switching component M4 is made to be more easily turned on, and therefore a low level state of the nth stage scan driving signal SCANn is made to be more stable.

However, due to the presence of the first capacitor C1, the kickback effect is generated, and the voltage of the node QA is pulled low, so that a voltage of the twelfth channel end of the sixth switching component M6 is lower than a voltage of the sixth control end of the sixth switching component M6, and the sixth switching component M6 is in a state equivalent to be turned off. Therefore, when the nth stage scan driving signal SCANn is maintained in the low level, the sixth switching component M6 is always in the state equivalent to be turned off.

Since the sixth switching component M6 is located between the fourth control end of the fourth switching component M4 and the first channel end of the first switching component M1, a situation that the first switching component M1 is directly connected with the fourth control end of the fourth switching component M4 in a very low voltage of the third stage to make a voltage value of the first channel end of the first switching component M1 too low is avoided. Therefore, the damage to the first switching component M1 which is very important in the scan driving circuit according to this embodiment is avoided, and thereby the scan driving circuit is protected.

The scan driving circuit according to the second embodiment of the present application includes the first switching component M1, the second switching component M2, the third switching component M3, the fourth switching component M4, the fifth switching component M5, the sixth switching component M6, the first capacitor C1 and the second capacitor C2. A normal scan driving signal may be outputted with the scan driving circuit, and the scan driving circuit may be referred to as a 6T2C scan driving circuit. The first capacitor C1 may make the fourth switching component M4 easier to be turned on and cooperate with the sixth switching component M6 to protect the scan driving circuit. The second capacitor C2 may make the fifth switching component M5 easier to be turned on. Therefore, both the first capacitor C1 and the second capacitor C2 may make the outputted nth scan driving signal SCANn more stable. In addition, the number of components used in the scan driving circuit according to the second embodiment of the present application is smaller than that of the existing scan driving circuit, and a space occupied by the scanning driving circuit according to the embodiments of the present application is reduced, which is more beneficial to a development trend of display devices having narrow frames.

Figure 4:
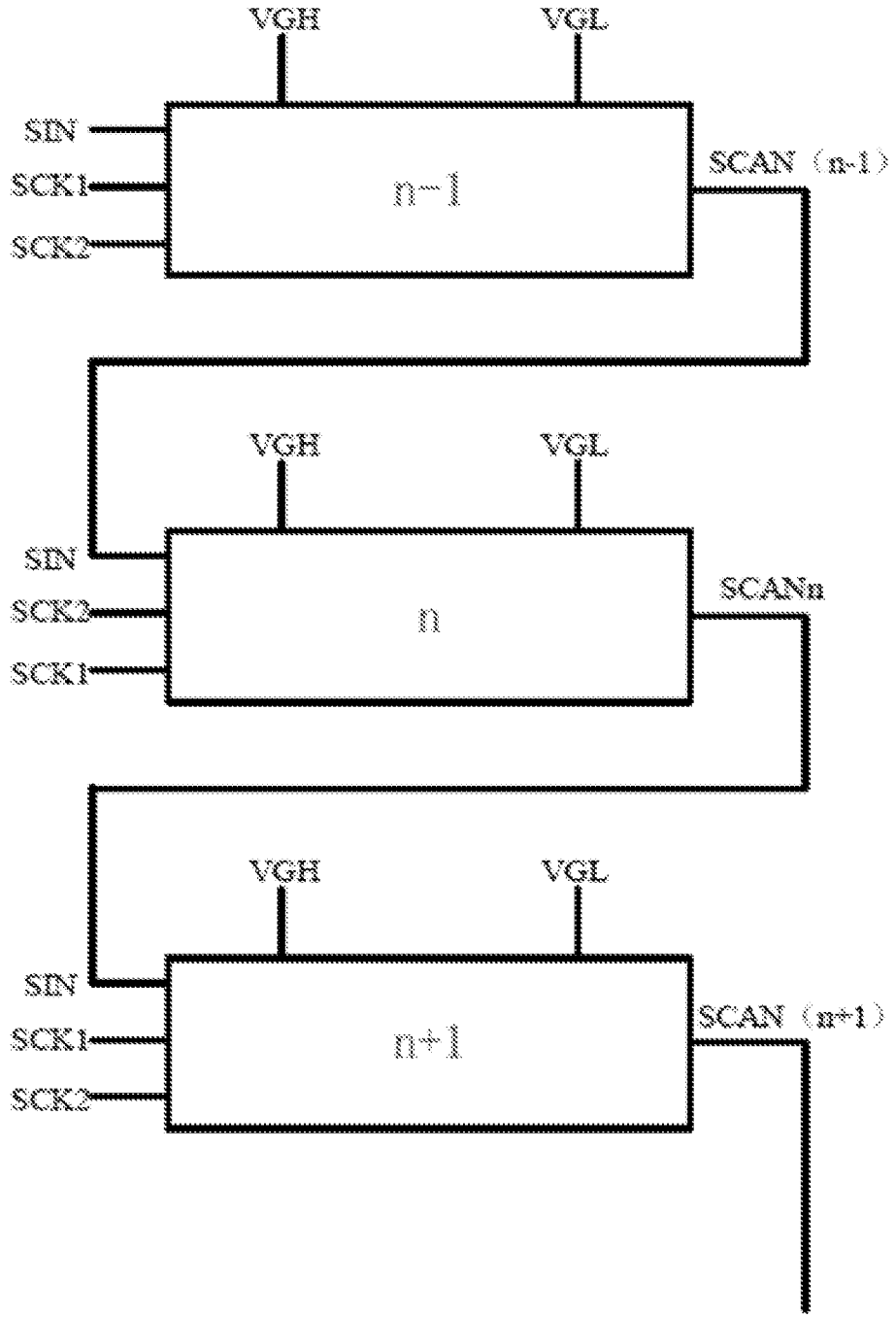
FIG. 4 is a module schematic diagram of a scan driver according to a third embodiment of the present application.

FIG. 4 is a module schematic diagram of a scan driver according to a third embodiment of the present application. In order to clearly describe the scan driver according to the third embodiment of the present application, please refer to FIG. 4.

The scan driver according to the third embodiment of the present application includes at least one scan driving circuit shown in FIG. 1 or 3. Specific embodiments and advantageous effects of the scan driving circuit may refer to the first embodiment and the second embodiment, details are not described herein again.

Referring to FIG. 4, in an embodiment, the scan driver includes N stages of scan driving circuits (N≥3), and a current stage scan driving circuit is a nth stage scan driving circuit, thereinto, N−1≥n≥1. A current stage scan driving signal of the current stage scan driving circuit is SCANn, and then a previous stage scan driving signal outputted by a previous stage scan driving circuit that has one stage difference with the current stage scan driving circuit is SCAN (n−1), and a next stage scan driving signal outputted by a next stage scan driving circuit that has one stage difference with the current stage scan driving circuit is SCAN(n+1).

Referring to FIG. 4, the scan driver according to the third embodiment of the present application includes a multi-stage scan driving circuit. Besides the start signal SIN of the scan driving circuit of a first stage needs to be externally provided, in any one of the scan driving circuits of remaining stages, the previous stage scan driving signal outputted by the previous stage scan driving circuit that has one stage difference with the current stage scan driving circuit is used as the start signal SIN of the current stage scan driving circuit.

The scan driver according to the embodiments of the present application includes the multi-stage scan driving circuit mentioned above. Since the scan driving circuit according to the embodiments of the present application may output a normal scan driving signal by using fewer components, and therefore a space occupied by the scan driving circuit according to the embodiments of the present application is reduced, and thus a volume of the scan driver is reduced, which is more beneficial to a development trend of display devices having narrow frames.

Figure 5:
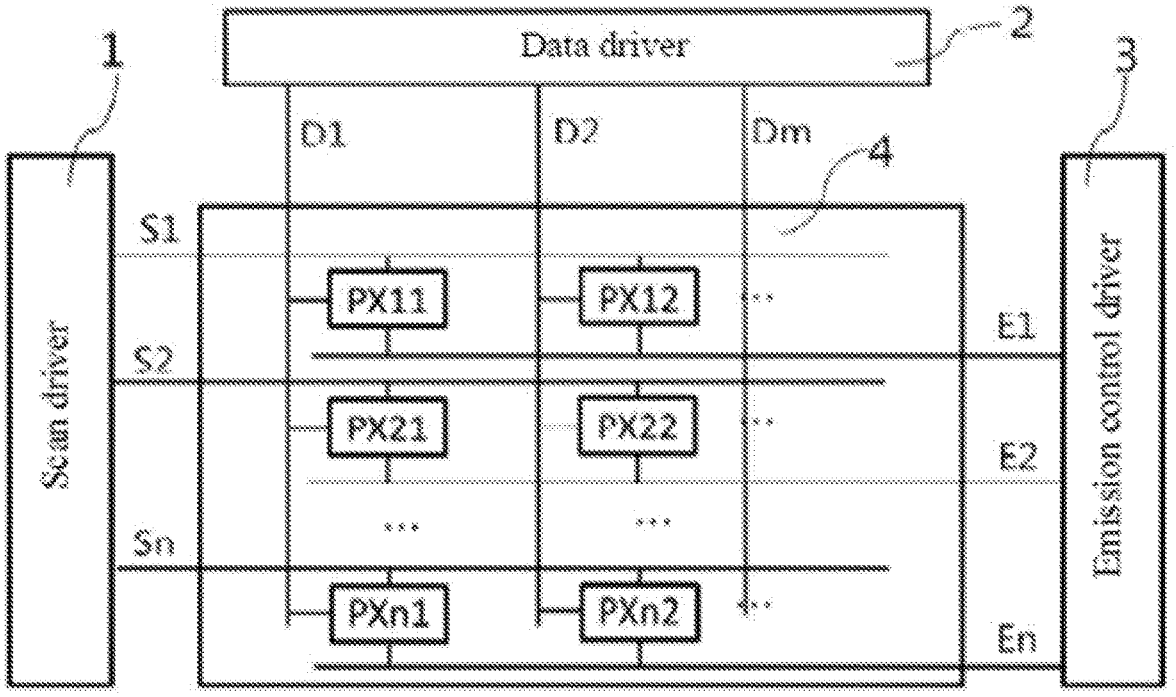
FIG. 5 is a structural schematic diagram of a display device according to a fourth embodiment of the present application.

FIG. 5 is a structural schematic diagram of a display device according to a fourth embodiment of the present application.

Referring to FIG. 5, the display device according to the fourth embodiment of the present application includes a scan driver 1, a data driver 2, an emission control driver 3 and a pixel panel 4. Specific embodiments and advantageous effects of the scan driver 1 may refer to the third embodiment, and details are not described herein again.

The pixel panel 4 is capable of displaying a plurality of pixels PXn1, PXn2 (n is an integer greater than zero) of an image according to a scan driving signal supplied from the scan driver 1, an emission control signal supplied from the emission control driver 3 and a data signal supplied from the data driver 2. A pixel PX includes an Organic Light Emitting Diode (OLED), which is configured to emit a light of a driving current corresponding to the data signal.

The multi-stage scan driving signals are supplied to the corresponding scan lines 51 to Sn by the scan driver 1 according to a control signal supplied from an external control circuit (for example, a timing controller), and then a certain row of the pixels PXn1, PXn2 is selected by the scan driving signal to correspondingly receive the data signals supplied from the data lines D1 to Dm. And then, the pixels PXn1, PXn2 are charged (stored) with voltages corresponding to the data signals and lights with luminance components corresponding to the voltages are emitted.

The emission control signals are supplied to the corresponding emission control lines E1 to En by the emission control driver 3 according to a control signal supplied from an external control circuit (for example, a timing controller). Then, the light-emitting time of the pixels PXn1, PXn2 is controlled by emitting a control signal.

In an embodiment, each pixel PX may form a red pixel that emits red light or a green pixel that emits green light or a blue pixel that emits blue light. That is, in an embodiment, the pixel panel 4 includes a red pixel, a green pixel and a blue pixel. One pixel unit constitutes at least one red pixel, at least one green pixel and at least one blue pixel which are adjacent. Therefore, the pixel unit may emit lights of different colors with luminance corresponding to the driving current, and thereby a color image may be displayed with the pixel panel 4.

In an embodiment, the scan driver 1 and the emission control driver 3 may be additionally mounted in a form of a chip, and/or embedded on a panel together with pixel circuit components in the pixel panel 4 to constitute an embedded circuit unit.

It may be understood that the display device according to the embodiments of the present application includes the scan driver 1. That is to say, in the embodiments of the present application, the narrow frame of the display device is reduced and then a development trend of display devices having narrow frames is facilitated by setting the scan driver 1 according to the above embodiments in the display device.

The above description is only for the preferred embodiments of the present application, and is not intended to limit the present application. Any modifications, equivalent substitutions or improvements made within the spirit and principles of the present application may be included in the scope of protection of the present application.

What is claimed is:

1. A scan driving circuit, comprising:

an output module comprising a first switching unit, a second switching unit and a scan driving signal output end, wherein one end of the first switching unit and wherein one end of the second switching unit being jointly connected with the scan driving signal output end, and wherein a port of the first switching unit being away from the scan driving signal output end receives a second clock signal, and a port of the second switching unit being away from the scan driving signal output end receives a first reference signal;

a first control module receiving a first clock signal and a start signal, and wherein operation of the first switching unit being controlled according to the first clock signal and the start signal; and a second control module receiving a second reference signal, and wherein operation of the second switching unit being controlled according to the operating state of the first control module and the second reference signal.

2. The scan driving circuit of claim 1, wherein the first control module comprises a first switching component, the first switching component comprises a first control end, a first channel end and a second channel end, and the first control end of the first switching component receives the first clock signal, and the second channel end of the first switching component receives the start signal;

the second control module comprises a second switching component and a third switching component, the second switching component comprises a second control end, a third channel end and a fourth channel end, the second control end of the second switching component is connected with the first channel end of the first switching component, the fourth channel end of the second switching component receives the first clock signal; the third switching component comprises a third control end, a fifth channel end and a sixth channel end, and the third control end of the third switching component receives the first clock signal, the fifth channel end of the third switching component is connected with the third channel end of the second switching component, and the sixth channel end of the third switching component receives the second reference signal; and the first switching unit of the output module comprises a fourth switching component, the second switching unit of the output module comprises a fifth switching component, the fourth switching component comprises a fourth control end, a seventh channel end and an eighth channel end, the fourth control end of the fourth switching component is connected with the second control end of the second switching component, the eighth channel end of the fourth switching component receives the second clock signal; the fifth switching component comprises a fifth control end, a ninth channel end and a tenth channel end, the fifth control end of the fifth switching component is be connected with the fifth channel end of the third switching component, the ninth channel end of the fifth switching component receives the first reference signal, and the tenth channel end of the fifth switching component is connected with the seventh channel end of the fourth switching component.

3. The scan driving circuit of claim 2, wherein the first control module further comprises a sixth switching component, the sixth switching component comprises a sixth control end, an eleventh channel end and a twelfth channel end, and the sixth control end of the sixth switching component receives the second reference signal, the eleventh channel end of the sixth switching component is connected with the second control end of the second switching component, and the twelfth channel end of the sixth switching component is connected with the fourth control end of the fourth switching component.

4. The scan driving circuit of claim 1, wherein the first reference signal is a reference high voltage signal, and the second reference signal is a reference low voltage signal.

5. The scan driving circuit of claim 2, wherein the output module further comprises a first conduction enhancement component, the seventh channel end of the fourth switching component is connected with the fourth control end through the first conduction enhancement component, and the conduction difficulty of the fourth switching component is reduced by the first conduction enhancement component.

6. The scan driving circuit of claim 5, wherein the first conduction enhancement component is a capacitive component.

7. The scan driving circuit of claim 2, wherein the output module further comprises a second conduction enhancement component, the ninth channel end of the fifth switching component is connected with the fifth control end of the fifth switching component through the second conduction enhancement component, and the conduction difficulty of the fifth switching component is reduced by the second conduction enhancement component.

8. The scan driving circuit of claim 7, wherein the second conduction enhancement component is a capacitive component.

9. The scan driving circuit of claim 8, wherein the second conduction enhancement component is a parasitic capacitance of the fifth switching component.

10. The scan driving circuit of claim 1, wherein the start signal is a scan driving signal outputted with the scan driving circuit differing with a preset number of stages.

11. The scan driving circuit of claim 10, wherein the preset number of stages is one, a start signal of a nth stage is a scan driving signal of a (n−1)th stage, and n is an integer greater than zero.

12. The scan driving circuit of claim 2, wherein at least one of the first switching component to the fifth switching component is a PMOS transistor.

13. The scan driving circuit of claim 12, wherein the first switching component is a double-gate PMOS transistor.

14. The scan driving circuit of claim 1, wherein the first clock signal and the second clock signal have a same duty ratio and a same cycle, and low levels of the first clock signal and those of the second clock signal are interleaved with each other.

15. A scan driver, comprising the scan driving circuit of claim 1.

16. A display device, comprising the scan driver of claim 15.

17. The display device of claim 16, further comprising a data driver, an emission control driver and a pixel panel, wherein the pixel panel displays pixels of an image according to a scan driving signal of the scan driver, an emission control signal of the emission control driver, and a data signal of the data driver.

* * * * *